US006860663B2

(12) United States Patent
Bernhard et al.

(10) Patent No.: US 6,860,663 B2
(45) Date of Patent: Mar. 1, 2005

(54) PRINTING DEVICE

(75) Inventors: Jürgen Bernhard, Empfingen (DE); Hans Michael Eppler, Albstadt (DE); Willi Sautter, Rosenfeld-Taebingen (DE)

(73) Assignee: Bizerba GmbH & Co. KG, Belingen (DE)

( * ) Notice: Subject to any disclaimer, the term of this patent is extended or adjusted under 35 U.S.C. 154(b) by 0 days.

(21) Appl. No.: 10/278,629

(22) Filed: Oct. 23, 2002

(65) Prior Publication Data

US 2003/0053835 A1 Mar. 20, 2003

Related U.S. Application Data

(63) Continuation of application No. PCT/EP01/02817, filed on Mar. 13, 2001.

(30) Foreign Application Priority Data

May 2, 2000 (DE) ..... 100 21 038

(51) Int. Cl.[7] ..... B41J 11/00

(52) U.S. Cl. ..... 400/611; 400/613; 400/692; 347/138

(58) Field of Search ..... 400/120.01, 578, 400/587, 611, 613, 692; 347/138, 108

(56) References Cited

U.S. PATENT DOCUMENTS 4,560,292 A * 12/1985 Takahashi ..... 400/59
4,831,393 A * 5/1989 Dean et al. ..... 347/152
4,900,175 A 2/1990 Ikeda et al.
5,106,215 A * 4/1992 Kitahara et al. ..... 400/175
5,238,314 A * 8/1993 Kitahara et al. ..... 400/208
5,528,277 A * 6/1996 Nardone et al. ..... 347/198
5,709,486 A 1/1998 Day
5,961,228 A * 10/1999 Ward et al. ..... 400/120.16
6,129,810 A * 10/2000 Schweitzer et al. ..... 156/387
6,353,453 B1 * 3/2002 Lien et al. ..... 347/198

FOREIGN PATENT DOCUMENTS

DE 4004930 A 8/1991
DE 4332574 A 3/1995
WO WO 9834791 A 8/1998

* cited by examiner

*Primary Examiner*—Andrew H. Hirshfeld
*Assistant Examiner*—Dave A. Ghatt
(74) *Attorney, Agent, or Firm*—Leydig, Voit & Mayer, Ltd.

(57) ABSTRACT

The printing device comprises a print head unit, a transporting device for the printing material and a structural housing board on which the print head unit and the transporting device are mounted at one end in cantilevered manner and in a predetermined relationship relative to one another. The transporting device comprises a stiff support member which is rigidly connected to the housing board, a mounting member which extends substantially parallel relative to the housing board and is held on the stiff support member, and at least one transport roller for the transportation of the strip of printing material which is mounted at both ends. The stiff support member comprises connecting elements for releasably fixing th mounting member and also guide elements which co-operate with corresponding guide elements of the mounting member for exactly positioning the arrangement with reference to the support member. The first end of the transport roller is mounted at the housing board side and is releasably connected to a drive device and the second end of the transport roller is releasably mounted at the mounting member side.

12 Claims, 4 Drawing Sheets

PRINTING DEVICE

The present disclosure relates to the subject matter disclosed in German application No. 100 21 038.4 of May 2, 2000, which is incorporated herein by reference in its entirety and for all purposes.

BACKGROUND OF THE INVENTION

The invention relates to a printing device for printing on printing material in the form of a roll, especially rolls of labels and/or receipts, including a print head unit and a transporting device for the printing material.

The purpose of the printing device incorporating the transporting device for the printing material (which is also referred to hereinafter as a roll printer or printer) is to wind off a strip of receipts or a strip of labels or the like from a roll, these receipts or labels that are to be printed upon being made of paper or synthetic material, to transport the strip through the roll printer and then, following the printing process, to eject the printed strip of printing material that is now in the form of a printed document from the printer for manual or automatic removal. In dependency on the nature of the document that is to be printed, there are different types of rolls which impose differing demands on the transporting device for the printing material during the transportation thereof through the printer. The present invention is mainly concerned with three different types of rolls which can be processed by the device in accordance with the invention:

Receipt or label rolls comprising a running, non-adhesive strip of printing material.

Self-adhesive label rolls comprising a backing strip, wherein the labels are stuck to a backing strip and are separated from one another.

Self-adhesive label rolls without a backing strip, so-called "linerless" label rolls, comprising a running, adhesive strip of printing material.

In the case of all three types of strips of material, the functional elements of the printing device that come into contact with the strip of printing material during the transportation process, especially the print head, the transport rollers, including the print roller, the stripping edge and the drawing off roller, are subjected to heavy soiling from abraded paper and residual remnants of the adhesive. Consequently, for functional reasons, it is necessary to clean these parts at relatively short intervals. Moreover, these parts are also subject to wear so that replacement thereof is necessary after a certain service life.

A printer is known from WO 98/34791 AI, wherein a thermal print head together with a rigidly attached fixing member forms a unit which is held in position by means of a permanent magnet. Replacement of the print head in the event of failure or for cleaning purposes cannot be effected without loosening screws, i.e. it cannot be dismantled without tools.

In addition, the transport rollers for the printing material and the drawing off edge cannot be dismantled without tools and must be adjusted thereafter, and they can only be accessed with difficulty for cleaning purposes.

A pressure roller is known from U.S. Pat. No. 4,900,175, wherein the hollow axle thereof is provided with recesses and a groove at one side. This is inserted in the axial direction into a matching central boring of a drive wheel where it is a snug-fit, and it latches therein in the functional position. The pressure roller can easily be dismantled in the axial direction by releasing the latch.

A printer having an easily dismantled print roller is known from DE 40 04 930 AI. The print roller, which is mounted at each end in the printer frame, can be removed from the printer perpendicular to the axis of the pressure roller after actuating two release buttons. The problem here, however, is that in the case of this construction, replacement of the printing material or a fresh insertion thereof causes difficulties and is an extremely laborious process.

The important thing for this purpose is a freely accessible, open side for the insertion of the strip of printing material.

SUMMARY OF THE INVENTION

The object of the present invention is to enable the parts of the transporting device coming into contact with the strip of printing material to be easily replaced from the freely accessible insertion side of the strip, without requiring subsequent adjustments.

In accordance with the invention, this object is achieved by a printing device for printing on printing material in the form of a roll, especially label and/or receipt rolls, including a print head unit, a transporting device for the printing material, a housing board, on which the print head unit and the transporting device are held at one end in cantilevered manner and in a predetermined relationship relative to one another, wherein the transporting device comprises a stiff support member which is rigidly connected to the housing board, a mounting member which extends substantially parallel relative to the housing board and is held on the stiff support member, and at least one transport roller for the transportation of the printing material which is mounted at both ends, wherein the stiff support member comprises connecting elements for releasably fixing the mounting member and also guide elements which co-operate with corresponding guide elements of the mounting member for exactly positioning the arrangement with reference to the support member, and wherein the first end of the transport roller is mounted at the housing board side and is releasably connected to a drive device and the second end of the transport roller is releasably mounted at the mounting member side.

A particularly easy to implement and thereby functionally excellent design for the guide elements of the mounting member and those of the stiff support member is provided in the form of studs and mutually matching borings. The studs may be provided selectively on the support member or on the mounting member or else on the support member and the mounting member, whereby the mounting member or the support member then comprises the borings matching the studs.

The mounting member may be rod-like or plate-like.

A particularly preferred embodiment of the mounting member is provided by a plug-in guide member which is displaceably guided in snug-fitting manner on the stiff support member perpendicularly relative to the plane of the housing board. Preferably, the guide means on the support member is designed in such a manner that the plug-in guide member can be displaced from a first operational position into a second non-operational position in which the plug-in guide member is still held on the support member, but the transport roller is freed for servicing/replacement.

The guide means of the plug-in guide member may, in principle, form the guide element for the support member and the section of the plug-in guide member sliding in the guide means may form the complementary guide element of the mounting member.

However, it is simpler for the purposes of manipulation and manufacture if the guide means of the plug-in guide member is produced with greater tolerances and if special guide elements are provided for the exact positioning process, especially in the form of the previously described studs and the mutually matching borings.

The mounting of the transport roller can, in principle, be such that the ends of the transport roller comprise bush bearings in which the bearing journals at the housing board and the mounting member sides engage. However, due to the fact that the transport roller represents a part subject to wear, this is preferably provided with bearing journals at the ends thereof so that they can then be inserted into bush bearings at the housing board and the mounting member sides.

Preferably, the mounting member, especially too in the form of the plug-in guide member, is fixed in the operational position by means of a latch formed on the stiff support member. Release of this latch enables the mounting member to be released and removed from the operational position in a particularly simple manner.

The plug-in guide member (or more generally, the mounting member) that is adapted to be released and removed by means of a handle enables, in advantageous manner, the transport roller and all of the parts of the transporting device coming into contact with the strip of printing material to be easily removed from the printer without the use of tools for the purposes of cleaning or replacement. A further advantage is that the dismantling and assembly of the parts requiring cleaning can be effected from the same side of the printer as is used for the insertion of the roll incorporating the strip of printing material that is to be printed.

This side of the printer, which is generally completely surrounded by a printer housing, must, in any case, be accessible via a housing door or flap for the purposes of inserting the receipt or label rolls. Consequently, no other housing parts need to be dismantled in order to dismantle the parts requiring cleaning.

With the aid of the printer design in accordance with the invention, each of the three types of label rolls or receipt rolls described hereinabove can be selectively processed on each occasion, namely with a thermal coating or, without a thermal coating in combination with a print ribbon unit or, where necessary, using other types of printing process, such as an e.g. inkjet process.

The replacement of the label or receipt roll by inserting the strip of printing material into the printer is effected in a very simple and user-friendly manner by means of a single actuation of a handle due to the cantilevered arrangement of the print head unit and the transporting device for the printing material on the housing board. If necessary, lifting of the thermal print head can thereby be simultaneously associated with a simultaneous pivoting action of a pivot roller.

The utilisation of an extruded profile as the stiff support member for the transporting device for the printing material is, in the embodiment thereof in accordance with the invention, a particularly advantageous and cost-effective solution. A plurality of functions can be implemented in a practical manner due to the extruded molding and the molded channels therein, such as for example, the mounting of the arrangement on the housing board, the guide-centralising process and the latching of the mounting member (and, if necessary, the guiding arrangement for the plug-in guide member) and hence, the mounting of the transportation pressure roller and the drawing off roller and the mounting of the stripping edge, the attachment and mounting of a light barrier for scanning the strip of printed material and the guiding arrangement for and the attachment of a deflector plate for the "linerless" label rolls.

Extremely good, uniform printing over the whole of the printing area is achieved by virtue of the stiffness of the extruded profile and an additional, single-sided adjustment of the lie of the print head should this need to be provided. This provides advantages, above all when printing on rolls of different widths.

The processing of rolls of differing widths is simplified still further by means of an additional adjustment of the drawing off roller. The effect is thereby achieved that, independently of the width of the roll, the edge of the strip of printing material facing the housing board will always run along the same stop member so that no adjustment will be necessary when inserting a roll of different width.

Mounting of the light barrier in a molded channel of the extruded profile in slideable manner has the advantage of allowing adjustment over at least half of the maximum width of the strip of printing material and hence the possibility of adapting the position of the light barrier to labels which are difficult to scan because their outer shape deviates from a rectangular shape. Thus, for example, round labels can be processed where, ideally, the scanning thereof should be effected at approximately the center of the diameter of the label.

Due to the construction of the universally employable transporting device for the printing material with its easily replaceable parts and groups of parts, there is also the advantage that it can easily be equipped or stripped when assembling the printer at the manufacturers or the users. Thus, for example, when using the printer as a simple receipt strip printer, the light barrier, the drawing off roller, the pivot roller and the wind-on roller may simply be left off although the basic concept remains the same, whilst it can subsequently be re-equipped if so desired.

As a result of the simple facility of inserting the strip of printing material laterally into the printer and the straight line path of the strip of printing material between the print head unit and the transportation unit without touching any parts, the printer is also suitable for processing "linerless" label rolls in an advantageous manner.

The only functional prerequisite is the need for a print roller having a non-stick surface coating, an additional deflector which prevents the adhesive strip of printing material from being wrapped around the transport/print roller and a non-stick coated deflector plate for covering the upper surface of the extruded profile.

Basically, these additional measures may be provided either on the printer, or they can be added later by simply replacing or installing the parts.

These and further advantages of the invention will be explained in greater detail hereinafter with the aid of the description and the drawings.

BRIEF DESCRIPTION OF THE DRAWINGS

FIGS. 1 and also 2A and 2B show a printer 1 for printing on a rolled strip of labels or receipts—referred to hereinafter as a strip of printing material 2—consisting of a transporting device 3 for the printing material and a print head unit 4 which are both secured at one end in cantilevered manner on the roller side 5 of a housing board 6 for the printer 1. The housing board 6 forms a part of the printer housing which, for the purpose of simplifying the Figures, is not illustrated and encloses the printer 1 on all side in known manner, and which comprises a housing door or flap for the insertion of the label or receipt roll and also an outlet opening for the printing material after it has been printed upon.

Figure 1:
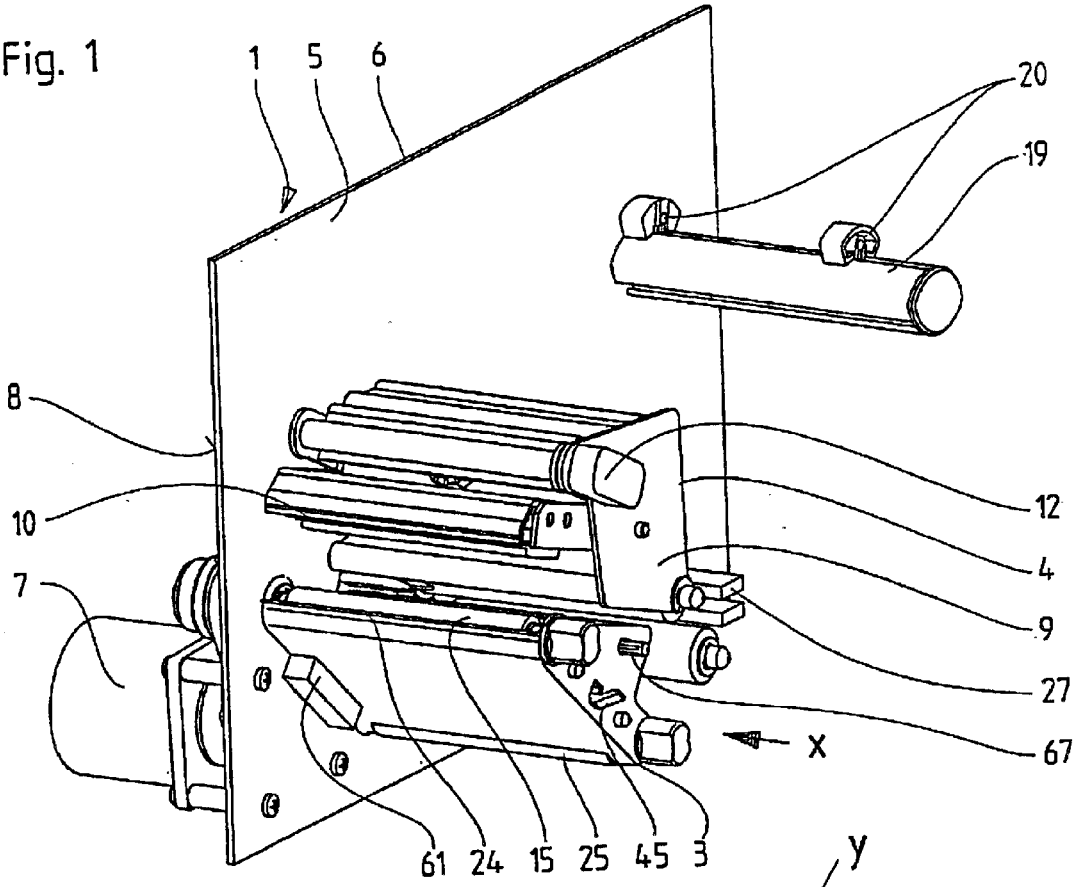
FIG. 1 shows a perspective front view of a printer in accordance with the invention but without the printer housing and the strip of printing material, FIGS. 2A–2B side views of the printer in the direction of the arrow X in FIG. 1 emphasising the path of the strip of printing material, FIG. 3 a perspective illustration of the transporting device for the printing material in accordance with the invention, including a mounting member which is illustrated in the disassembled position, FIG. 4 a partial view of a part-section of the transporting device for the printing material in the direction of the arrow Y in FIG. 3, FIG. 5 a section A—A of FIG. 4.

The drive means 7 for the transporting device 3 for the printing material is arranged on the opposite, driver side 8 of the housing board 6 which is remote from the roller side 5. The not illustrated control system for the printer is also preferably located on this driver side 8 which is not accessible to the operating personnel.

The print head unit 4 is constructed in accordance with the known state of the art and, in consequence, it will not be described in detail. A thermal print head 10 is pivotally mounted about a pivotal axis 11 on a stiff print head mounting 9 which is rigidly connected to the housing board 6. The thermal print head 10 can be moved from an insertion position 13 for the printing material which is illustrated by full lines in FIGS. 2A and 2B into a printing position 14 which is illustrated by dash-dotted lines by means of a handle 12 and an additional, not illustrated lever mechanism. Here, as is known, the lever mechanism executes a resilient over-throw action so that the printing line of the thermal print head 10 will rest on a print roller 15 of the transporting device 3 for the printing material under the influence of a corresponding spring force. The thermal heating elements 16 forming a printing line thereby lie, in known manner, in parallel with the print roller 15 on the surface of the strip of printing material 2 which is fed in the direction of the arrow 17 between the driven print roller 15 functioning as a transport roller and the stationary thermal print head 10. The printable side 18 of the strip of printing material 2 facing the thermal print head 10 is provided with a thermo sensitive layer which is converted into another colour thereby producing a printed image as a result of the increase in temperature which occurs when the thermal heating elements 16 covering the whole width of the strip of printing material 2 are appropriately controlled.

As a departure from the so-called direct thermal printing process described above, the printer may also be used as a thermal transfer printer by adding a driven print ribbon. This printing process is likewise known in the state of the art. Consequently, the illustration of the print ribbon and the drive means therefore has been dispensed with. In the case of the thermal transfer printing technique, an additional print ribbon is moved in synchronism between the thermal print head 10 and the strip of printing material 2 and, by appropriate control of the thermal heating elements 16, ink from the print ribbon is transferred to the surface of the strip of printing material 2 which does not comprise a thermosensitive layer in the case of this printing technique. Basically however, the design of the transporting device 3 for the printing material and the print head unit 4 remain the same when switching from direct thermal printing to thermal transfer printing.

Figure 2A:
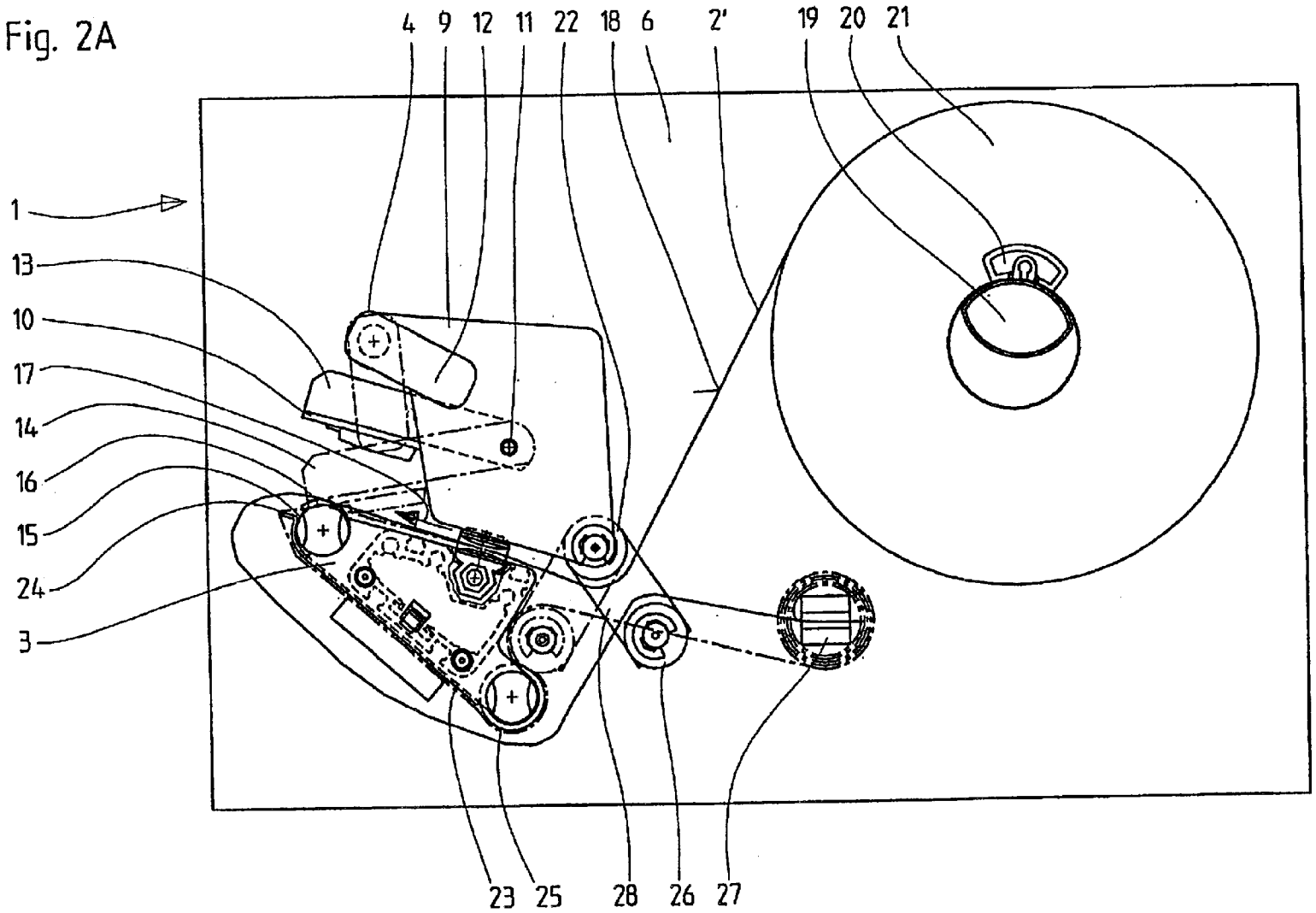
Figure 2B:
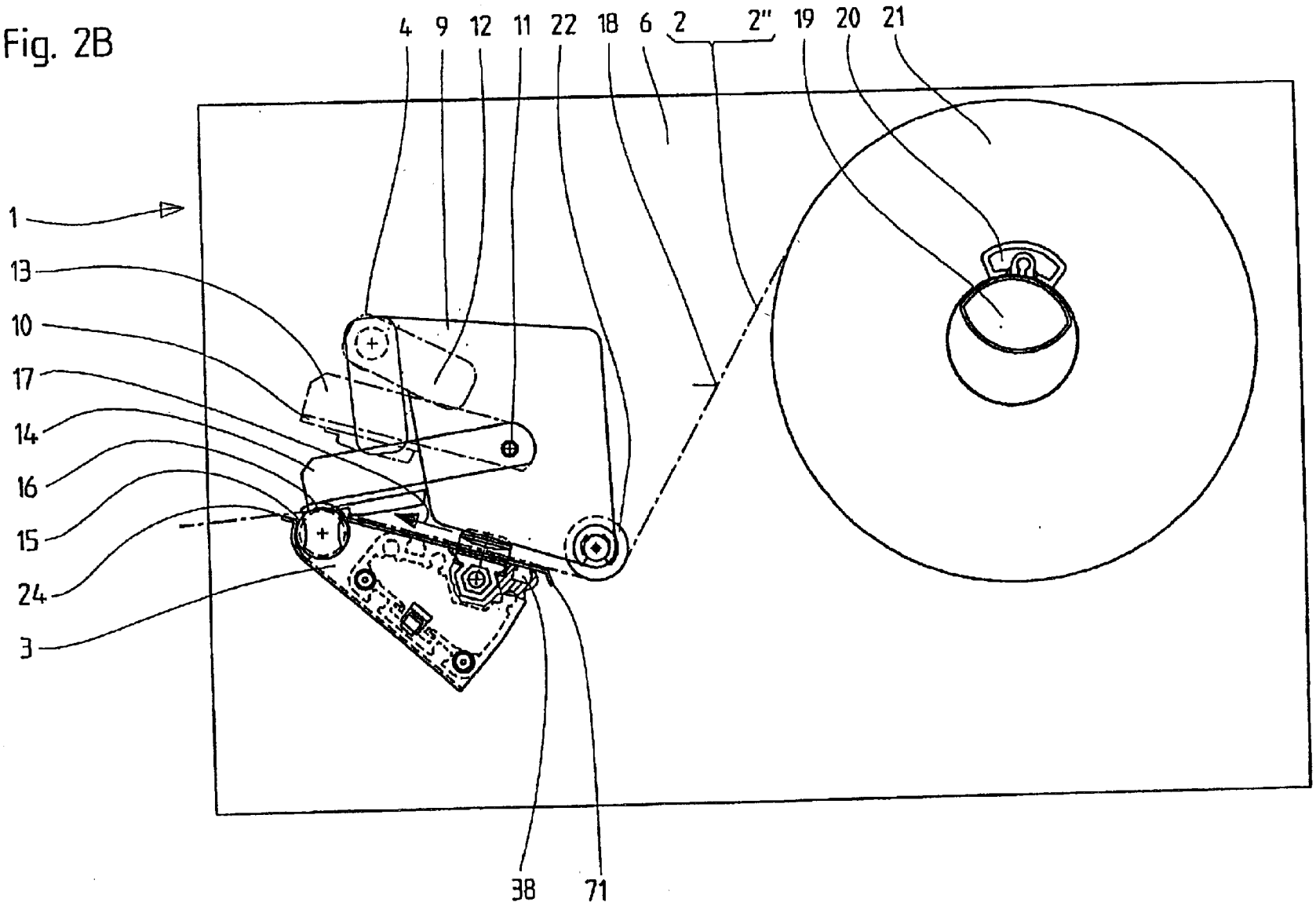

The path of the clearly emphasised strip of printing material 2, 2' or 2" through the printer 1 is illustrated in FIGS. 2A and 2B in the insertion position 13 of the thermal print head 10. This path varies however in dependence upon which of the three types of roll that have already been explained in connection with the description of the state of the art is to be printed upon and issued as a printed document.

a) Receipt or Label Rolls Having a Running, Non-adhesive Strip of Printing Material (FIG. 2B)

The strip of printing material 2 of a receipt or label roll 21 that is loosely mounted on a dispensing mandrel 19 and is fixed laterally by two stop members 20 is deflected over a guide roller 22 and then runs between the mutually spaced print head unit 4 and the transporting device 3 for the printing material whereafter it passes between the thermal print head 10 and the print roller 15 for printing purposes.

The driven print roller 15 transports the strip of printing material 2 further in the direction of the arrow 17 to a not illustrated outlet opening in the printer housing whereat the printed document is either separated manually at a knife edge or mechanically by means of a driven cutting device, or it is rewound onto a roll externally of the printer in an additional, not illustrated unit. These could also be self-adhesive labels that are stuck to a backing strip and exit from the printer in the form of complete strips and are only detached from the backing strip at a later time point.

b) Self-adhesive Label Rolls on a Backing Strip (FIG. 2A)

In known manner, the self-adhesive labels are adhered, either immediately adjacent to one another or mutually spaced, to the side of a backing strip 23 facing the thermal print head 10. The labels, together with the backing strip 23, form the strip of printing material 2' illustrated in FIG. 2A. The path followed by this strip as far as the print roller 15 is identical to that of the roll of type a). However, immediately following the print roller 15, the backing strip 23 is turned sharply round a stationary drawing off edge 24. This causes the labels to be separated from the backing strip 23 and, following the stripping edge 24, to be dispensed in the direction of the arrow 17 through a not illustrated outlet opening in the printer housing.

The drawing off force needed to strip off the labels is produced by means of a pair of rollers which are disposed after the drawing off edge 24 and consist of a driven drawing off roller 25 and a pivot roller 26. The backing strip 23 is then wound up by means of a likewise driven winding mandrel 27. In order to insert a new label roll 21, the thermal print head 10 is pivoted into the insertion position 13 by means of a handle 12. This movement of the handle 12 simultaneously causes, via a not illustrated lever mechanism, a pivot lever 28 having the pivot roller 26 mounted therein at one end to pivot away from the printing position depicted by dash-dotted lines in FIG. 2A into the insertion position illustrated by full lines in order to simplify the process of inserting the strip of labels 2'. After it has been pivoted back into the functional position depicted by the dash-dotted lines, the pivot roller 26 causes wrapping of approximately 180° to occur around the driven drawing off roller 25 and hence slip-free transportation of the backing strip 23. The pressure roller 15 and the drawing off roller 25 are provided with a resilient covering 68 of rubber or synthetic material for improving the transportation properties.

c) Self-adhesive Label Rolls Without a Backing Strip ("Linerless" Labels) (FIG. 2B)

The "linerless" strip of labels 2" is wound onto the label roll 21 with the adhesive surface on the inside. The outer face 18 that is to be printed upon is provided, as is known, with an additional non-stick coating so as to easily enable the superimposed turns on the stock roll 21 to be released from one another. The path of the strip of labels 2" through the printer and the emission of the printed document is the same as for the roll of type a). The pressure roller 15 thus simultaneously forms the transport roller for the "linerless" strip of labels 2".

In contrast to a) however, the adhesive rear face of the "linerless" strip of labels 2" must be prevented from adhering to parts of the printer 1 during its passage therethrough. Consequently, additional, inherently known measures are necessary, such as a non-stick coating on the print roller 15, an additional deflector on the print roller 15 for preventing the adhesive strip of labels 2" from being wrapped around it and a non-stick coating on every part which could come into contact with the adhesive side of the strip of labels 2".

Figure 3:
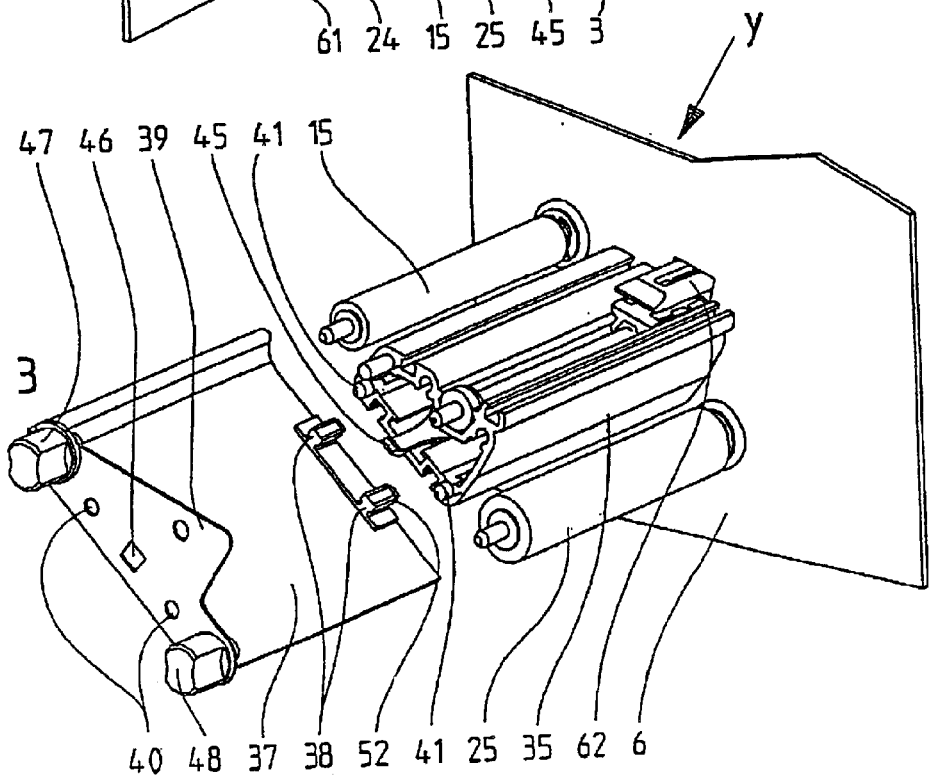
Figure 4:
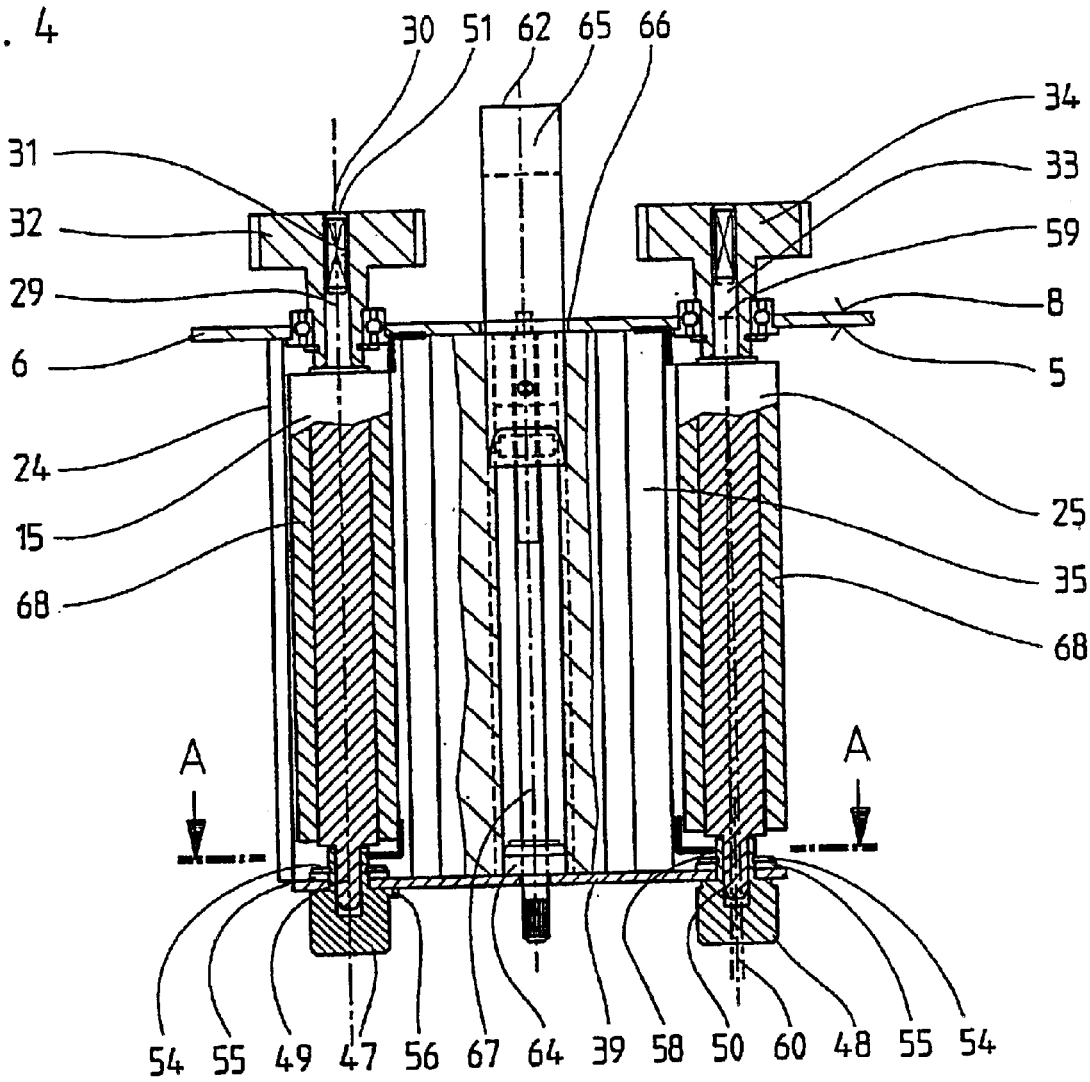
Figure 5:
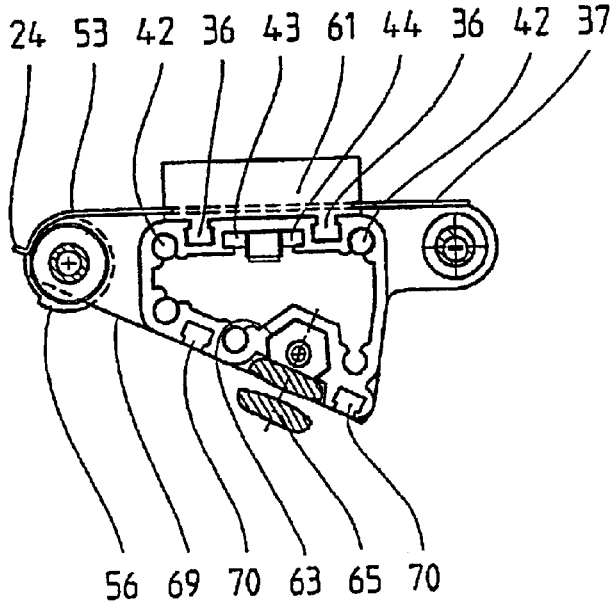

The transporting device 3 for the printing material in accordance with the invention is illustrated in detail in FIGS. 3 to 5. The print roller 15, which simultaneously forms a transport roller for the strip of printing material 2, 2', 2", is mounted by means of its left-hand, first bearing journal 29 in the housing board 6, said bearing journal 29 comprising a shaped portion differing from the circular shape, e.g. a key surface 30 which is insertable in snug-fitting, play-free manner into a matching central boring 31 in a drive wheel 32 thereby enabling the print roller 15 to rotate therewith in slip-free manner. The drive wheel 32 is connected to the drive motor 7, e.g. via a not illustrated toothed belt.

In the same manner as for the print roller 15, the drawing off roller 25 is mounted in the housing board 6 by means of a ball bearing 59 via its left-hand bearing journal 33 which is a snug-fit centrally of the drive wheel 34 so as to rotate therewith.

A stiff support member 35, which is formed from an extruded profile of aluminium and comprises two dove-tailed grooves 36 at its lower end for accommodating a plug-in guide member 37, is fixed perpendicularly relative to the housing board 6 between the print roller 15 and the drawing off roller 25 on the roller side 5 of the housing board 6. The plug-in guide member 37 likewise comprises two projections 38 that match the grooves 36 and it is thereby displaceably mounted in the stiff support member 35 perpendicularly relative to the housing board 6.

A leg 39 is bent up through 90° from the plug-in guide member 37 which is in the form of a sheet-like part, said leg being provided with two centralising borings 40 with which the plug-in guide member 37 is fixed on two centralising studs 41 when it is inserted into its functional position. The centralising studs 41 are pressed into molded channels 42 in the extruded profile 35, which channels are in the form of segments of a circle.

A molded part of synthetic material 44 is fixed in a further dove-tailed molded channel 43 in the extruded profile 35, there being formed on said molded part a resilient latch 45 which latches in a recess 46 in the leg 39 when the plug-in guide member 37 is inserted into its functional position. Two bush bearings 47, 48 are attached to the leg 39, said bushes being respectively aligned with the print roller 15 and the drawing off roller 25 and serving to accommodate the bearing for the right-hand bearing journal 49 of the print roller 15 and the right-hand bearing journal 50 of the drawing off roller 25.

By pressing on the easily accessible resilient latch 45, the plug-in guide member 37 can easily be released and removed in a direction perpendicular relative to the housing board 6. Thereafter, the print roller 15 and the drawing off roller 25 can be removed in the same direction, e.g. for cleaning purposes or for replacement by a new roller.

In order to make the mounting of the rollers 15 and 25 even easier, respective pilot chamfers 51 are formed on the respective pairs of bearing journals 29, 49 and 33, 50. The two projections 38 are also provided with pilot bevels 52 for easy insertion of the plug-in guide member 37.

A radius-like shaped portion 53 is bent up from the plug-in guide member 37 below the print roller 15, a straight end piece, the so-called stripping edge 24, being formed at the edge of said shaped portion. Consequently, an additional part is not required for this stripping edge 24 which is needed for the purposes of detaching the self-adhesive labels from the backing strip. Due to the integration thereof in the plug-in guide member 37, this is stiffened in an advantageous manner as a result of the radius-like shaped portion 53. The insertion of the plug-in guide member 37 is thereby simplified and the stripping edge 24 is easy to clean when the plug-in guide member 37 has been removed.

An additional fine adjustment means is built into the bearing for the right-hand bearing journal 49 of the pressure roller 15 for adjusting the parallelism of the thermal print head 10 relative to the print roller 15, as can best be seen from FIGS. 4 and 5. The bush bearing 47 is fixed in the leg 39 of the plug-in guide member 37 in such a manner that it is secured axially by means of a locking washer 54 but is adapted to rotate in sluggish manner by virtue of an additional corrugated washer 55 that is clamped between the leg 39 and the locking washer 54. An additional adjustment cam 56, upon which the thermal print head 10 rests in the printing position, is formed on the bush bearing 47. By rotating the bush bearing 47 and hence the very slowly rising adjustment cam 56 formed thereon, the parallelism of the thermal print head 10 and of the print roller 15 relative to one another can be adjusted and the results of the printing operation thereby optimised. The cam 56 thereby forms a stop member for the thermal print head 10. This is particularly important when printing a narrow label roll and the strip of labels 2' (the strip of printing material) runs off-center relative to the thermal print head 10 in the vicinity of the housing board 6. As a stop member, the cam 56 prevents the thermal print head 10 from tipping onto the right-hand side during the resilient setting thereof into the printing position 14.

A further method of adjusting the transporting device 3 for the printing material is to be found in the bearing for the drawing off roller 25. The right-hand bearing journal 50 is mounted in a bush bearing 48 that is fixed in the leg 39 of the plug-in guide member 37, this bush bearing 48, in like manner to the bush bearing 47, being secured axially by means of a locking washer 54 and being adapted to rotate in sluggish manner by virtue of an additional corrugated washer 55 that is clamped between the leg 39 and the locking washer 54. The bush bearing 48 has a neck collar 58 located eccentrically of the central boring so that the drawing off roller 25 will execute a slight pivotal movement about its left-hand bearing 59 in the housing board 6, which bearing is in the form of a ball bearing, when the bush bearing 48 is turned. The pivoting of the central axis 60 of the drawing off roller 25 that is normally perpendicular to the housing board 6 affects the straight line path of the strip of printing material 2' and the backing strip 23 through the printer 1. A backing strip stop member 61 is rigidly attached to the end of the plug-in guide member 37 facing the housing board 6. The bush bearing 48 is now adjusted such that the edge of the backing strip 23 facing the housing board 6 tends towards the stop member 61 and presses lightly against it whilst it is running. It is thereby possible, in advantageous manner, to process self-adhesive label rolls of differing width that are disposed on a backing strip (rolls of the b. type) without adjusting the bush bearing 48 and without the need for a second backing strip stop member at the other edge of the backing strip.

During its passage through the printer, the strip of printing material 2, 2' and 2" passes through a forked light barrier 62 which is used for scanning the labels on the backing strip 23, or for scanning for printed forms which are already present on the stock roll 21. The scanning signals are used by the printer control system, as is known, for synchronising the outer contours of the labels or the pre-existing printed forms with the printed image that is to be printed thereafter by the thermal print head 10.

For the purposes of accommodating the forked light barrier 62, a preferably hexagonal molded channel 63 is formed in the extruded profile 35, a bush bearing 64 being pressed into the molded channel at the end face of the extruded profile 35 remote from the housing board 6. A forked light barrier body 65 is mounted in slideable manner on the plate side of the extruded profile 35 in the molded channel 63 and partially projects through a break-through 66 in the plate 6 into the drive space 8. The forked light barrier 62 can be adjusted transversely relative to the strip of printing material 2, 2' or 2" over a large range of adjustment by means of a threaded spindle 67 which is mounted and axial secured in the bush bearing 64 and the housing board 6. This is especially advantageous when self-adhesive labels that differ from a rectangular shape, e.g. round labels, are being processed whereby the scanning thereof should ideally be effected approximately centrally relative to the diameter of the labels.

For printing on self-adhesive labels without a backing strip ("linerless"), whence each of the parts coming into contact with the adhesive side of the label strip 2" should be coated in non-stick manner, the upper surface 69 of the extruded profile 35 must also be coated in non-stick manner, e.g. with PTFE. As an alternative solution to this, rather than a non-stick coating, the upper surface 69 could be covered by a not illustrated, additional deflector plate that is itself coated in non-stick manner. As was the case for the plug-in guide member 37, two projections 38 may, for example, be formed on the deflector plate, said projections being matched to two molded channels 70 in the extruded profile 35 into which the deflector plate can be inserted and then secured between the housing board 6 and the leg 39 following the mounting of the plug-in guide member 37.

The embodiment of the present invention that has been described merely serves as an illustration of the inventive concept and it also encompasses other alternative and equivalent embodiments which would be perceptible to the skilled person from a reading of the embodiment described, e.g. the implementation of a simple strip printer which dispenses with a light barrier, a stripping edge, a drawing off roller, a pivot roller and a wind-on roller.

In particular, it can be perceived from the preceding description, that the printing device in accordance with the invention may be constructed and equipped in such a manner that all of the currently available types of label can be processed by the same printing device without the need for modifications thereto. In like manner, it is apparent that a printing device that is initially designed for the printing of receipt rolls can be easily and cheaply converted for printing on "linerless" label rolls or can be added to the printer for backing strip type labels.

What is claimed is:

1. A printing device for printing on printing material in the form of a roll, the device comprising a print head unit, a transporting device for the printing material, a housing board, on which the print head unit and the transporting device are mounted at one end in cantilevered manner and in a predetermined relationship relative to one another, the transporting device comprising a stiff support member which is rigidly connected to the housing board, a mounting member having guide elements and which extends substantially parallel relative to the housing board and is held on the stiff support member, and at least one transport roller for the transportation of the printing material, the transport roller having first and second ends and being mounted at both of said first and second ends, the stiff support member comprising connecting elements for releasably fixing the mounting member, and guide elements which co-operate with corresponding guide elements of the mounting member for positioning the mounting member with reference to the support member, the first end of the transport roller being mounted to the housing board and being releasably connected to a drive device, the second end of the transport roller being releasably mounted to the mounting member, and the stiff support member being formed from an extruded profile, comprising grooves arranged perpendicularly relative to the housing board for accommodating the mounting member in snug-fitting and slideable manner, and comprising two molded channels in the form of segments of a circle for accommodating centralizing studs for fixing a position of the mounting member in a precise manner.

2. A printing device for printing on printing material in the form of a roll, the device comprising a print head unit, a transporting device for the printing material, a housing board, on which the print head unit and the transporting device are mounted at one end in cantilevered manner and in a predetermined relationship relative to one another, the transporting device comprising a stiff support member which is rigidly connected to the housing board, a mounting member having guide elements and which extends substantially parallel relative to the housing board and is held on the stiff support member, and at least one transport roller for the transportation of the printing material, the transport roller having first and second ends and being mounted at both of said first and second ends, the stiff support member comprising connecting elements for releasably fixing the mounting member, and guide elements which co-operate with corresponding guide elements of the mounting member for positioning the mounting member with reference to the support member, the first end of the transport roller being mounted to the housing board and being releasably connected to a drive device, the second end of the transport roller being releasably mounted to the mounting member, the mounting member comprising a leg bent through 90°, said leg being provided with at least one centralizing boring which is fixed by at least one centralizing stud when the mounting member is inserted into a functional position thereof, said support member comprising a molded channel in the form of a segment of a circle, said centralizing stud being pressed into said molded channel of the support member.

3. A device in accordance with claim 2, further comprising a bush bearing, the second end of the transport roller being mounted in said bush bearing, said bush bearing being arranged in the leg of the mounting member such as to be aligned with the transport roller.

4. A device in accordance with claim 2, wherein a recess is formed in the leg of the mounting member, and a resilient latch of a molded member that is fixed in the molded channel of the support member latches in said recess.

5. A device in accordance with claim 2 for use in printing self-adhesive labels with a backing strip, wherein, for stiffening purposes, the mounting member comprises a radius-like shaped portion which extends in parallel with the transport roller, the shaped portion serving as a print roller, the shaped portion comprising a stripping edge for the separation of the self-adhesive labels from the backing strip.

6. A printing device for printing on printing material in the form of a roll, the device comprising a print head unit, a transporting device for the printing material, a housing board, on which the print head unit and the transporting device are mounted at one end in cantilevered manner and in a predetermined relationship relative to one another, the transporting device comprising a stiff support member which is rigidly connected to the housing board, a mounting member having guide elements and which extends substantially parallel relative to the housing board and is held on the stiff support member, and at least one transport roller for the transportation of the printing material, the transport roller having first and second ends and being mounted at both of said first and second ends in bearing journals, the stiff support member comprising connecting elements for releasably fixing the mounting member, and guide elements which co-operate with corresponding guide elements of the mounting member for positioning the mounting member with reference to the support member, the first end of the transport roller being mounted to the housing board and being releasably connected to a drive device, the second end of the transport roller being releasably mounted to the mounting member, a drawing off roller, the drawing off roller being insertable in snug-fitting, play-free manner by means of a first bearing journal into a matching boring in a drive wheel mounted in the housing board, the first bearing journal having a section thereof that differs from a circular shape whereby the drawing off roller rotates with the drive wheel without slipping, and the mounting member comprising a leg, and a bush bearing arranged in the leg of the mounting member such as to be aligned with the drawing off roller, wherein said bush bearing forms the mounting for a second bearing journal of the drawing off roller, pilot chamfers being formed on the two bearing journals of the transport roller and on the first and second bearing journals of the drawing off roller, and the stiff support member comprising two projections, the two projections being provided with pilot bevels.

7. A printing device for printing on printing material in the form of a roll, the device comprising a print head unit, a transporting device for the printing material, a housing board, on which the print head unit and the transporting device are mounted at one end in cantilevered manner and in a predetermined relationship relative to one another, the transporting device comprising a stiff support member which is rigidly connected to the housing board, a mounting member having guide elements and which extends substantially parallel relative to the housing board and is held on the stiff support member, and at least one transport roller for the transportation of the printing material, the transport roller having first and second ends and being mounted at both of said first and second ends, the stiff support member comprising connecting elements for releasably fixing the mounting member, and guide elements which co-operate with corresponding guide elements of the mounting member for positioning the mounting member with reference to the support member, the first end of the transport roller being mounted to the housing board and being releasably connected to a drive device, the second end of the transport roller being releasably mounted to the mounting member, the mounting member being fixed in lockable and releasable manner by means of a latch formed on the stiff support member, one of the mountings of the transport roller serving as a print roller and being formed such that it is rotatable in sluggish manner, an adjustment cam being formed the mounting, and a thermal print head that rests on said cam in a printing position of the cam, parallelism of the thermal print head relative to the transport roller being adjustable by rotation of the mounting.

8. A printing device for printing on printing material in the form of a roll, the device comprising a print head unit, a transporting device for the printing material, a housing board, on which the print head unit and the transporting device are mounted at one end in cantilevered manner and in a predetermined relationship relative to one another, the transporting device comprising a stiff support member which is rigidly connected to the housing board, a mounting member having guide elements and which extends substantially parallel relative to the housing board and is held on the stiff support member, and at least one transport roller for the transportation of the printing material, the transport roller having first and second ends and being mounted at both of said first and second ends, the stiff support member comprising connecting elements for releasably fixing the mounting member, and guide elements which co-operate with corresponding guide elements of the mounting member for positioning the mounting member with reference to the support member, the first end of the transport roller being mounted to the housing board and being releasably connected to a drive device, the second end of the transport roller being releasably mounted to the mounting member, a drawing off roller, said drawing off roller being insertable in snug-fitting, play-free manner by means of a first bearing journal into a matching boring in a drive wheel that is mounted in the housing board, the first bearing journal having a section thereof that differs from a circular shape, whereby the drawing off roller rotates with the drive wheel without slipping, a bush bearing, which is rotatable in sluggish manner, the bush bearing being provided for mounting a second bearing journal of the drawing off roller, said bush bearing comprising a neck collar that is located eccentrically relative to a mounting position, and the drawing off roller executing a slight pivotal movement about said first bearing journal in the housing board when the bush bearing is rotated.

9. A device in accordance with claim 8, wherein, the path of the printing material through the printer is adjustable by rotation of the bush bearing in such a manner that a left-hand edge of a backing strip of the printing material facing the housing board rests on a backing strip stop member that is fixed to the mounting member.

10. A printing device for printing on printing material in the form of a roll, the device comprising a print head unit, a transporting device for the printing material, a housing board, on which the print head unit and the transporting device are mounted at one end in cantilevered manner and in a predetermined relationship relative to one another, the transporting device comprising a stiff support member which is rigidly connected to the housing board, a mounting member having guide elements and which extends substantially parallel relative to the housing board and is held on the stiff support member, and at least one transport roller for the transportation of the printing material, the transport roller having first and second ends and being mounted at both of said first and second ends, the stiff support member comprising connecting elements for releasably fixing the mounting member, and guide elements which co-operate with corresponding guide elements of the mounting member for positioning the mounting member with reference to the support member, the first end of the transport roller being mounted to the housing board and being releasably connected to a drive device, the second end of the transport roller being releasably mounted to the mounting member, and a forked light barrier, the forked light barrier being mounted in slideable manner on the support member perpendicularly relative to the housing board.

11. A device in accordance with claim 10, wherein the forked light barrier is adjustable perpendicularly relative to the housing board by means of a threaded spindle.

12. A printing device for printing on printing material in the form of a roll, the device comprising a print head unit, a transporting device for the printing material, a housing board, on which the print head unit and the transporting device are mounted at one end in cantilevered manner and in a predetermined relationship relative to one another, the transporting device comprising a stiff support member which is rigidly connected to the housing board, a mounting member having guide elements and which extends substantially parallel relative to the housing board and is held on the stiff support member, and at least one transport roller for the transportation of the printing material, the transport roller having first and second ends and being mounted at both of said first and second ends, the support member comprising an upper surface comprising two molded channels adapted to accommodate a deflector plate having a non-stick coating thereon, the stiff support member comprising connecting elements for releasably fixing the mounting member, and guide elements which co-operate with corresponding guide elements of the mounting member for positioning the mounting member with reference to the support member, the first end of the transport roller being mounted to the housing board and being releasably connected to a drive device, the second end of the transport roller being releasably mounted to the mounting member.

* * * * *